United States Patent [19]

Lo

[11] Patent Number: 4,826,152

[45] Date of Patent: May 2, 1989

[54] FASTENING DEVICE FOR HANDLE SUPPORT OF SKIING

[76] Inventor: Yuan-Hung Lo, 3Fl., No. 85, Sec. 2, Chien-Kuo N. Rd., Taipei, Taiwan

[21] Appl. No.: 145,970

[22] Filed: Jan. 20, 1988

[51] Int. Cl.[4] ..... A63B 69/18; A63B 21/22; F16B 7/10

[52] U.S. Cl. ..... 272/97; 403/108; 403/362; 272/132

[58] Field of Search ..... 272/70, 97, 73, DIG. 4, 272/61, 62, 132; 403/108, 344, 362; 411/352, 353; 248/316.1, 316.2; 273/80 D, 81.2

[56] References Cited

U.S. PATENT DOCUMENTS

| | | | |
|---|---|---|---|
| 3,463,520 | 8/1969 | Turro | 403/362 |
| 4,528,998 | 7/1985 | Gamm | 403/108 |
| 4,700,942 | 10/1987 | Danchulis | 272/73 |

FOREIGN PATENT DOCUMENTS

| | | | |
|---|---|---|---|
| 1516075 | 3/1968 | France | 272/97 |

*Primary Examiner*—Richard J. Apley

*Assistant Examiner*—S. R. Crow

*Attorney, Agent, or Firm*—Bernard R. Gans

[57] ABSTRACT

A fastening device applied to fasten a pair of handle supports on a skiing machine has an upper semi-circular clipping element which is complemented by a matching lower semi-circular clipping element to receive a bending terminal of handle support. A semi-circulr recess is provided at an external central region of the upper semi-circular clipping element, and a circular depression is provided at an external center region of the lower semi-circular clipping element. A cylindrical housing, mounted on a base of the skiing machine encases the upper and lower semi-circular clipping elements, and has two openings. A securing knob is applied to secure the upper semi-circular clipping element and the cylindrical housing together tightly, which is threaded through an opening on the cylindrical housing into the recess with a pad. A retarding bolt is disposed between the base, cylindrical housing and lower semi-circular clipping element. A spring element urges the retarding bolt to insert tightly therebetween.

2 Claims, 3 Drawing Sheets

FASTENING DEVICE FOR HANDLE SUPPORT OF SKIING

BACKGROUND OF THE INVENTION

The present invention relates to a fastening device for the handle support of skiing machine, and more particularly relates to a fastening device which is made of a spring means.

Various types of fastening devices for handle supports of various machines have been developed in many parts of the world, but not without their drawbacks. As is well-known, it is difficult to assemble fastening devices on machines. Further, most fastening devices cannot tightly secure the fastened machines. The present invention can actually obviate and/or mitigate the above-mentioned drawbacks.

SUMMARY OF THE INVENTION

A primary objective of the present invention is to provide a fastening device which can tightly secure the combination of a pair of handle supports on skiing machines.

Another objective of the present invention is to provide a fastening device which can be used to adjust the inclination of both handle supports on skiing machines.

Still another objective of the present invention is to provide a fastening device which is easy to mount on and to slip off.

Another objective of the present invention is to provide a fastening device which has performance characteristics superior to any heretofore available.

Further objectives and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
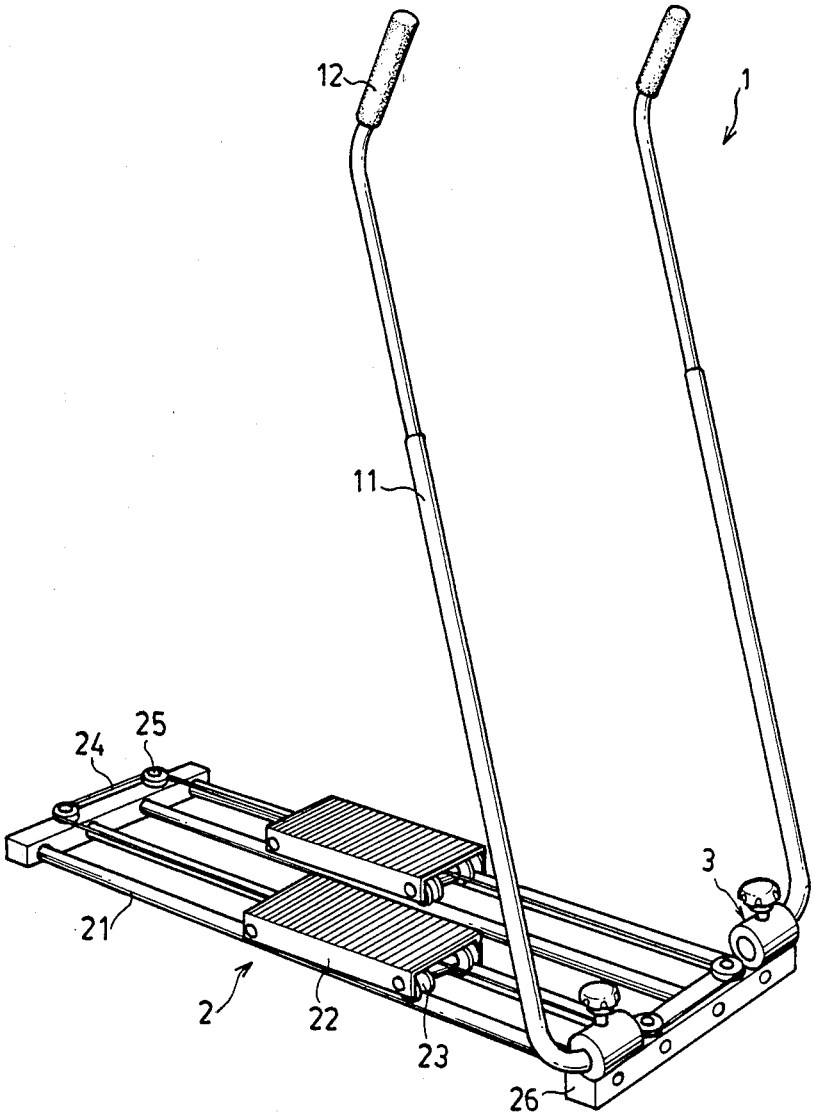
FIG. 1 is a perspective view of a skiing machine which applies a fastening device in accordance with the present invention.

For purposes of illustration, the present invention is shown applied to a skiing machine 1, such as shown in FIG. 1. As is common in skiing machines, a pair of handle supports 11, which lift a pair of handle bars 12, are mounted on a frame 2 by a pair of fastening devices 3. The frame 2 is formed by four horizontal rails 21 wherein two pedals 22 are provided on the rails and are slidable thereon, since a plurality of rollers 23 are disposed at the underside of the pedals 22 to facilitate movement of the pedals 22 on the rails 21. An endless cord 24 is tightened around four pulleys 25 provided on the frame 2, and extends between the pedals 22 and rollers 23. The cord 24 is fastened to the underside by a known means (not shown) so that the two pedals and the cord move as an entity. This results in the movement of one pedal driving the other pedal to move simultaneously.

Figure 2:
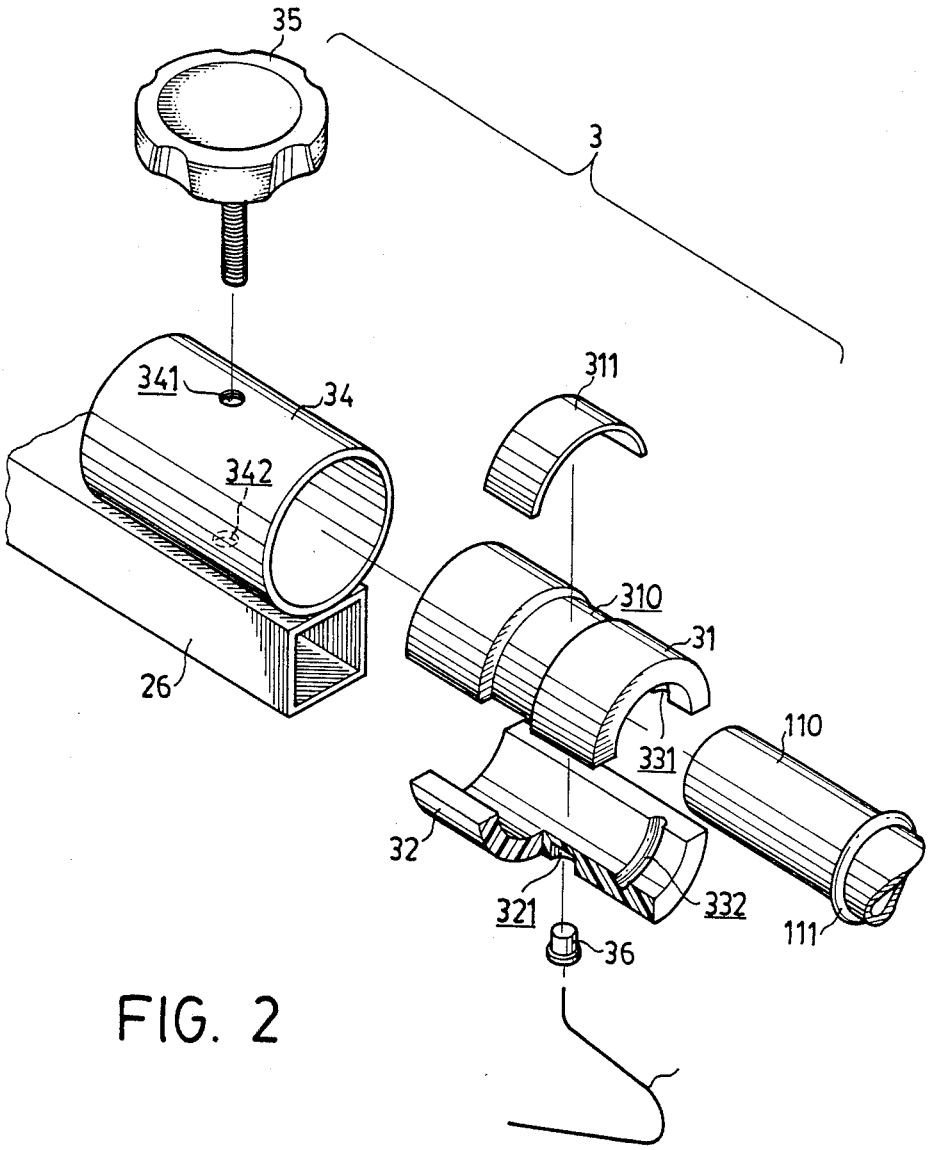
FIG. 2 is an exploded view of the fastening device of FIG. 1.

The fastening device 3, as best shown in FIG. 2, has an upper semi-cylindrical clipping element 31, which is complemented by a matching lower semi-cylindrical clipping element 32 to form a chamber for receiving a L-shaped terminal 110 of handle support 11. Two semi-circular channels 331, 332 are provided on the upper and lower semi-circular clipping elements 31, 32, respectively, so that a retaining means channel 111 mounted on the L-shaped terminal 110 is engaged therein. This can prevent the L-shaped terminal 110 from sliding along the upper and lower semi-cylindrical clipping elements 31, 32. The upper semi-cylindrical clipping element 31 has a recess 310 running along the circumference thereof and the lower semi-cylindrical clipping element 32 has a hole 321 provided at the outer cylindrical surface thereof.

The upper and lower semi-cylindrical clipping elements 31, 32 are encased by a cylindrical housing 34 mounted on the base 26 of the frame 2. Aligning with an opening 261 (shown in FIG. 3) on the base 26, the cylindrical housing 34 also has two openings 341, 342 wherein opening 342 is shown in dotted lines.

Figure 3:
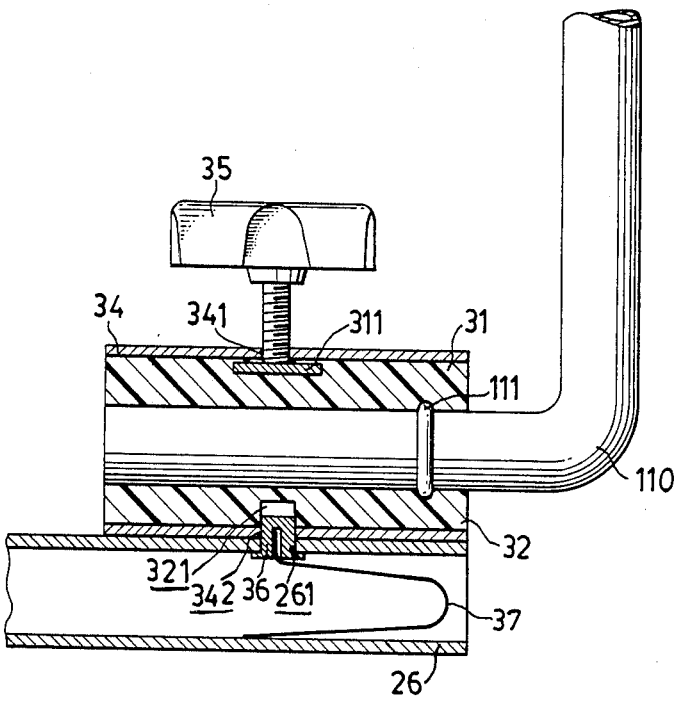
FIG. 3 is a cross-sectional view of the fastening device of FIG. 1.

Referring to FIG. 3, a securing knob 35, which secures the upper semi-cylindrical clipping element 31 to the cylindrical housing 34 together tightly, is perpendicularly threaded through opening 341 into the recess 310 with a pad 311 disposed thereon, such that the pad 311 can prevent the securing knob 35 from contacting the recess 310. A spring loaded stop means 36 with a slot positioned at the top center thereof is retained from opening 261 through opening 342 into the hole 321, wherein a spring means 37 is pressed within the bore of the base 26. The spring means 37 urges the stop means 36 to insert tightly into the hole 321 by the tension thereof since the bent end of the spring means 37 inserts into the slot of the stop means 36. This can secure the base 26 of the frame 2 and the fastening device 3 together tightly. Comprehensibly, the inclination of the handle supports 11 is adjustable by loosing the engagement of the securing knob 35 on the cylindrical housing 34 and can be set in a predetermined inclination by fastening the engagement thereof to prevent the rotation of the handle supports 11. Moreover, since the retaining means 111 is lodged in the clearance formed by the semi-circular channels 331 and 332 to prevent the movement of the handle supports 11 along the axial direction thereof, the fastening device as per this invention can secure the handle supports 11 on the skiing machine.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A fastening device for handle supports of a skiing machine, comprising upper and lower semi-cylindrical clipping elements, a securing knob, spring-loaded stop means and a cylindrical housing which is mounted on a base of said skiing machine to encase said upper and lower clipping elements;

said upper semi-cylindrical clipping element having a recess running along a circumference thereof and said cylindrical housing having a first opening passing therethrough so that said securing knob is threaded into said recess through said first opening to secure said upper semi-cylindrical clipping element in said cylindrical housing;

said lower semi-cylindrical clipping element having an aperture at an outer cylindrical surface thereof;

said cylindrical housing and base having openings aligned with said aperture so that said stop means is retained within said aperture and said openings of said cylindrical housing and said base for preventing movement of said lower semi-cylindrical clipping element with respect to said cylindrical housing and said base; and semi-circular channels being provided in inner walls of said upper and lower semi-circular clipping elements, said upper and lower semi-circular clipping elements cooperatively forming a chamber to receive one of said handle supports so that said channels in said clipping elements engage retaining means near a terminal end of said one handle support, said retaining means for preventing said one support handle from disengaging from said chamber.

2. A fastening device according to claim 1, wherein a pad is disposed on said recess to prevent said securing knob from contacting said recess.

* * * * *